United States Patent [19]

Latina et al.

[11] Patent Number: 4,720,875

[45] Date of Patent: Jan. 26, 1988

[54] BASEBALL GLOVE WITH ADJUSTABLE WEB AND FINGER STALLS

[75] Inventors: Roland N. Latina, Belleville, Ill.; Robert L. Clevenhagen, Ava, Mo.

[73] Assignee: Figgie International Inc., Richmond, Va.

[21] Appl. No.: 3,632

[22] Filed: Jan. 15, 1987

[51] Int. Cl.[4] ..... A41D 13/08

[52] U.S. Cl. ..... 2/19; 2/161 A

[58] Field of Search ..... 2/19, 161 R, 161 A, 2/159, 160, 16

[56] References Cited

U.S. PATENT DOCUMENTS

| | | | |
|---|---|---|---|
| 1,631,735 | 6/1927 | Kennedy et al. | 2/19 |
| 1,826,851 | 10/1931 | Whitley | 2/19 |
| 2,629,096 | 2/1953 | Latina | 2/19 |
| 2,988,744 | 6/1961 | Stobbe | 2/19 |

*Primary Examiner*—Louis K. Rimrodt
*Assistant Examiner*—Judith L. Olds
*Attorney, Agent, or Firm*—Senniger, Powers, Leavitt and Roedel

[57] ABSTRACT

A baseball or softball glove comprising front and back walls joined together to form thumb and finger stalls, a web between the thumb and the first finger stall, upper lacing interconnecting the thumb stall, web and finger stalls at their upper ends, and lower lacing interconnecting the thumb stall, web and finger stalls between their upper and lower ends. The lower lacing comprises a plurality of reaches of lacing lying in generally parallel planes extending generally at right angles to the finger stalls and spaced at intervals along the finger stalls, each reach running continuously along a curvilinear path, as viewed from above the glove, through openings in the thumb stall, web and finger stalls. The depth of the web relative to the thumb stall and the first finger stall and the spacings between individual finger stalls are readily adjustable by tightening or loosening the reaches of lower lacing.

11 Claims, 10 Drawing Figures

BASEBALL GLOVE WITH ADJUSTABLE WEB AND FINGER STALLS

BACKGROUND OF THE INVENTION

This invention relates to baseball and softball gloves and, more particularly, to an improved glove construction which permits adjustment of the depth of the web and the spacing between the individual fingers stalls of the glove.

In conventional baseball (and softball) gloves, adjusting the depth of the web of the glove and the spacing between individual finger stalls of the glove is difficult. This can be a serious drawback since some players with certain catching styles prefer shallow webs, while others with other catching styles prefer deeper webs which have a greater tendency to "snare" or trap the ball. Moreover, after considerable use, the lacing interconnecting the thumb stall, finger stalls and web of a glove tends to stretch, leaving gaps which may not be desired. Heretofore, it has been less than convenient to tighten the lacing and close these gaps.

SUMMARY OF THE INVENTION

Among the several objects of this invention may be noted the provision of a baseball (or softball) glove wherein the depth of the web and the spacings between the individual finger stalls are readily adjustable; the provision of such a glove which is adapted to retain its shape longer than gloves of conventional construction; and the provision of such a glove which is durable.

In general, a baseball or softball glove of this invention comprises front and back walls joined together to form thumb and first-through-last finger stalls separated by intervening crotches, a web between the thumb and the first finger stall, upper lacing interconnecting the thumb stall, web and finger stalls at their upper ends, and lower lacing interconnecting the thumb stall, web and finger stalls between their upper and lower ends. The lower lacing comprises a plurality of reaches of lacing lying in generally parallel planes extending generally at right angles to the finger stalls and spaced above the crotches at intervals along the finger stalls, each reach running continuously along a curvilinear path, as viewed from above the glove, through openings in the thumb stall, web and finger stalls. The depth of the web relative to the thumb stall and the first finger stall and the spacings between the individual finger stalls are readily adjustable by tightening or loosening the reaches of lower lacing.

Other objects and features will be in part apparent and in part pointed out hereinafter.

BRIEF DESCRIPTION OF THE DRAWINGS

Corresponding reference characters designate corresponding parts throughout the several views of the drawings.

DESCRIPTION OF THE PREFERRED EMBODIMENT

Figure 1:
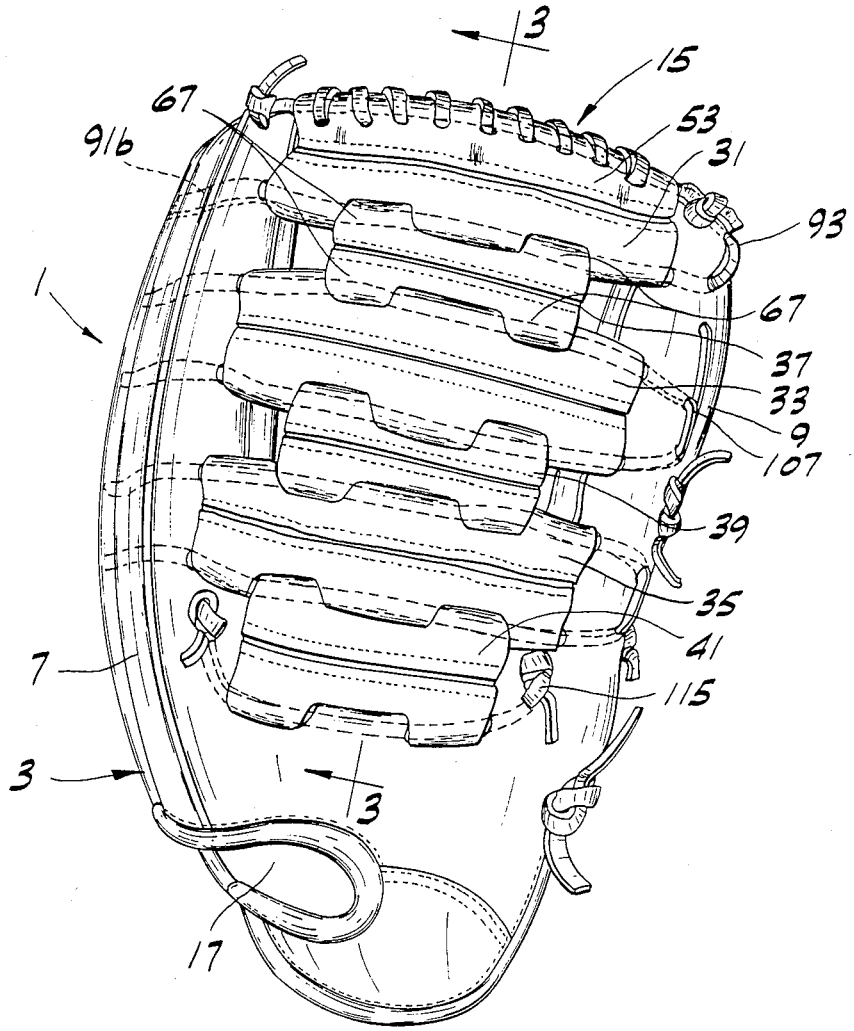
FIG. 1 is a rear elevational view of a glove having the adjustment feature of this invention.

Referring now to the drawings, a baseball (or softball) glove of the present invention is indicated in its entirety by the reference numeral 1. As is conventional, the glove is made of leather, although it may be made of other flexible sheet material. The outer shell of the glove, generally designated 3, comprises front and back walls indicated at 5 and 7, respectively. In the glove shown, which is a fielder's glove, the front and back walls of the glove are joined together to form a thumb stall 9 for the thumb of a player wearing the glove, and four separate finger stalls designated 11*na*–11*d* into which a player may insert his (or her) fingers at least partially. The thumb and finger stalls are separated by four intervening crotches 13*a*–13*d*. A web between the thumb stall 9 and first finger stall 11*a* is indicated at 15. The glove has a hand-receiving opening 17 at the bottom of the glove through which the hand is inserted into the glove.

Figure 2:
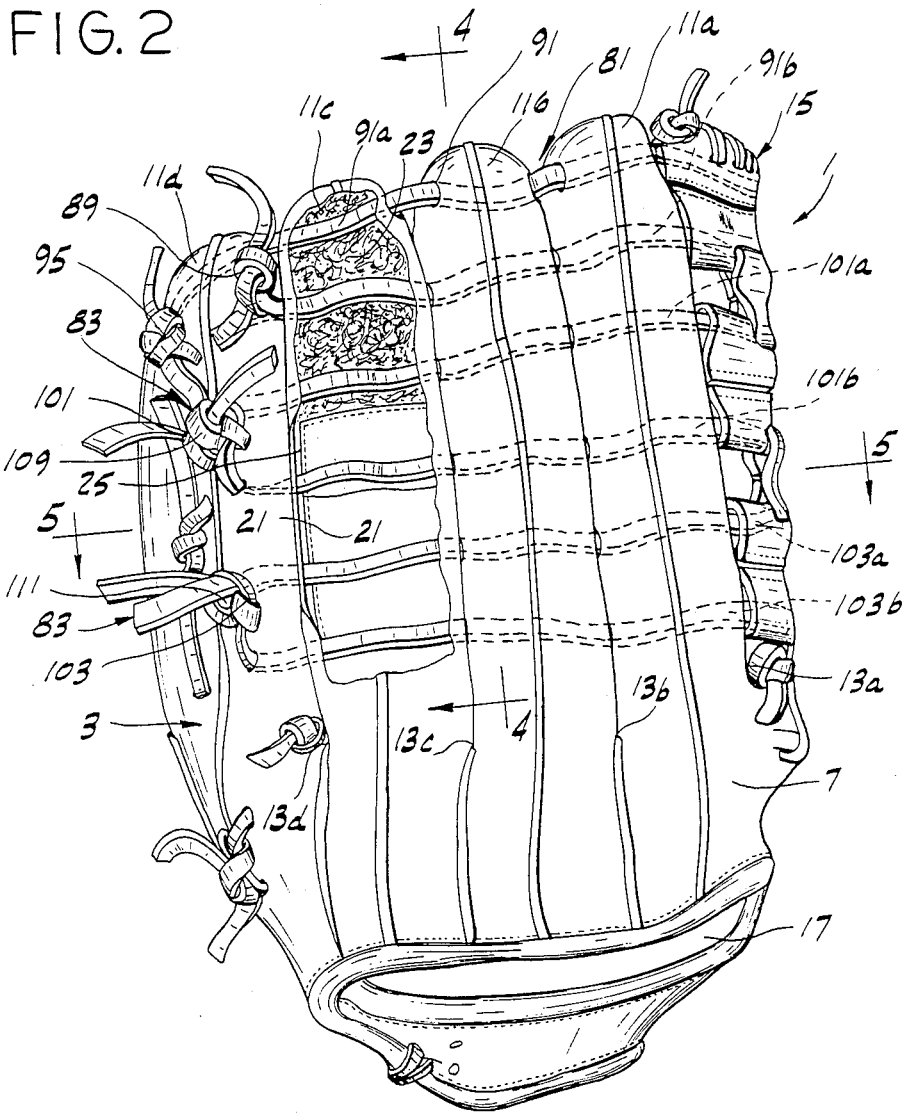
FIG. 2 is a rear elevational view of the glove with portions removed to illustrate details.
Figure 3:
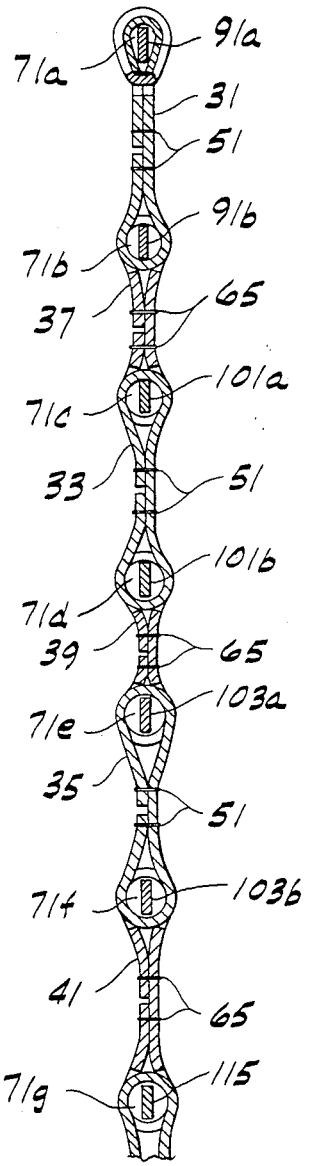
FIG. 3 is an enlarged vertical section taken on line 3—3 of FIG. 1 showing the construction of the web.
Figure 4:
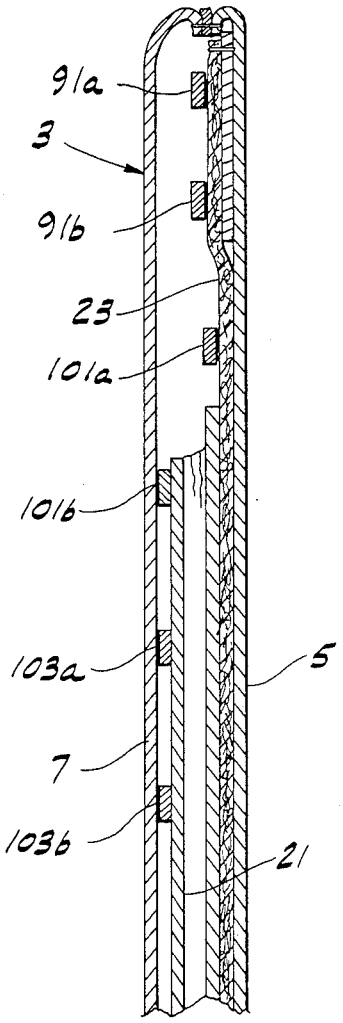
FIG. 4 is a vertical section on line 4—4 of FIG. 2.

As shown in FIGS. 2 and 4, the glove also includes a conventional liner having finger portions (each designated 21) extending partway up into the thumb stall 9 and finger stalls 11*a*–11*d* of the shell. Strips 23 of padding are interposed between these finger portions 21 and the front wall 5 of the glove, the strips being secured to the glove by stitching 25.

Figure 6:
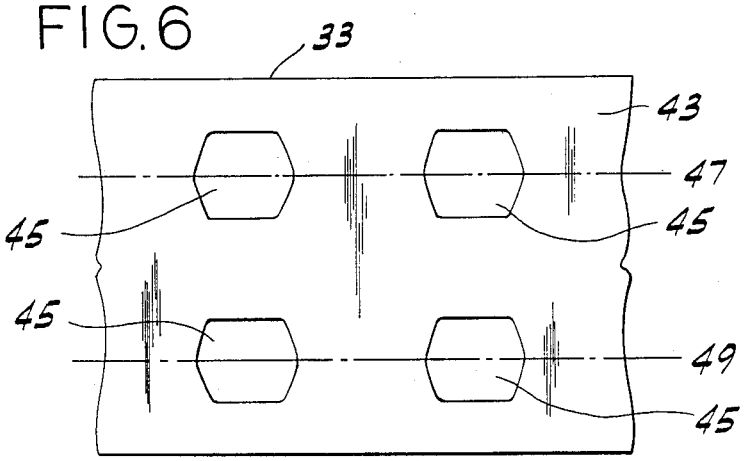
FIG. 6 is a flat pattern of a web component.
Figure 6A:
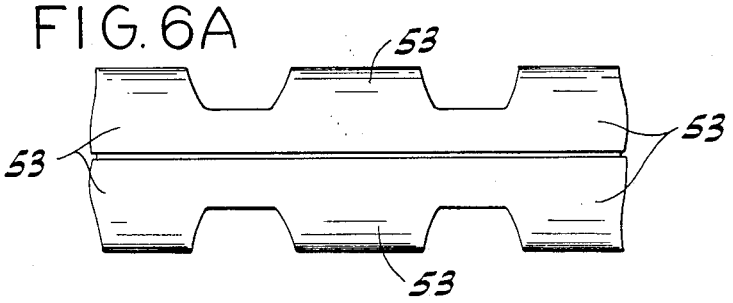
FIG. 6A is a web component formed in accordance with the pattern of FIG. 6.

More specifically, the web 15 of the glove comprises a plurality of generally parallel cross members 31, 33, 35 extending the width of the web with their ends immediately adjacent the thumb stall 9 and the first finger stall 11*a*, and a plurality of bridge members 37, 39, 41 bridging the spaces between the cross members. A flat pattern for one of the cross members (33) is illustrated in FIG. 6 and is shown as comprising a generally rectangular piece 43 of material (e.g., leather) having four openings (each designated 45) therein arranged in two rows of two. To form the cross member, the upper and lower margins of the material are doubled over on two parallel fold lines indicated at 47 and 49 and the folded-over edges secured alongside one another on one face of the material by stitching 51 to form six loop portions 53, three along the upper edge of the cross member and three along its lower edge (FIG. 6A). Cross member 35 is of identical construction. Cross member 31 is of similar construction, differing in that there is only one continuous loop portion 53 along its upper edge.

Figure 7:
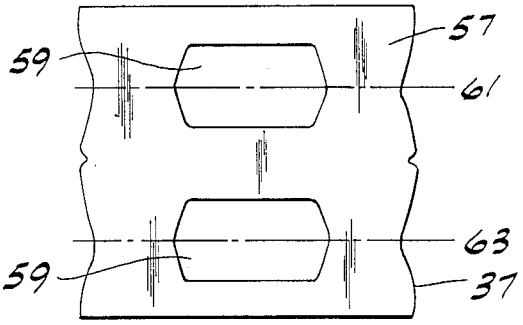
FIG. 7 is a flat pattern of another web component.
Figure 7A:
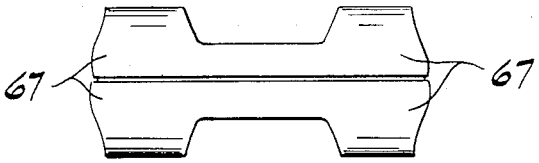
FIG. 7A is a web component formed in accordance with the pattern of FIG. 7.

A flat pattern for one of the bridge members (37) is shown in FIG. 7 as comprising a generally rectangular piece 57 of material having a pair of openings 59 therein. To form the bridge member, the upper and lower margins of the material are doubled over on two parallel fold lines indicated at 61 and 63 and the folded-over edges secured alongside one another on one face of the material by stitching 65 to form four loop portions 67, two along the upper edge of the bridge member and two along its lower edge (FIG. 7A). All three bridge members 37, 39, 41 are of identical construction.

The web 15 is constructed by assembling the cross members and bridge members in the manner shown, that is, with the loop portions 53 of the cross members and the loop portions 67 of the bridge members interdigitated, the upper loop portion 53 of the upper cross member 31 forming a tunnel designated 71*a* and the interdigitated loop portions 53 of the cross members and bridge members forming tunnels 71*b–f* extending generally transversely (horizontally as viewed in the drawings) of the web. The lower two loop portions 67 of bridge member 41 are interdigitated with loop portions 73 formed in the body of the glove in the crotch area 13*a* between the thumb and finger stalls to form a tunnel 71*g*.

Figure 8:
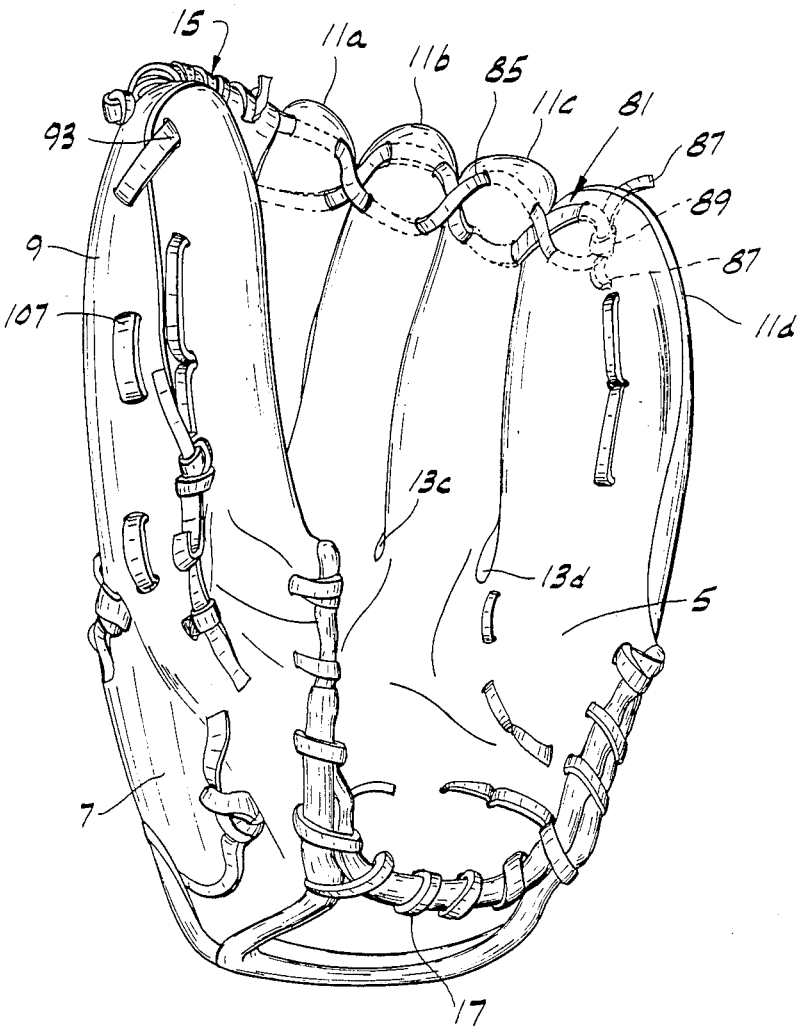
FIG. 8 is a front elevational view of the glove.

The thumb stall 9, web 15 and finger stalls 11*a–*11*d* are interconnected at their upper ends by upper lacing generally designated 81 and between their upper and lower ends by what may be referred to a lower lacing generally desingated 83. As shown in FIGS. 2 and 8, the upper lacing 81 comprises a strip of lacing 85 laced through openings in the finger stalls in crisscross fashion adjacent the top of the glove at the front of the glove and having free ends 87 which are secured at 89 after exiting the back wall of the last finger stall. The upper lacing also includes a continuous integral (one-piece) strip of lacing 91 having an upper generally horizontal stretch or reach 91*a* extending in one direction through the finger stalls 11*a–*11*d* immediately rearward of the finger portions 23 of the padding, through tunnel 71*a* and thence through the front wall of the thumb stall and out the back wall of the glove at 93, and a generally parallel lower reach 91*b* which doubles back and traverses the glove in the opposite direction, extending through tunnel 71*b*, the finger stalls 11*a–*11*d* immediately rearward of the finger portions 23 of the padding, and exiting the back wall of the little finger stall where it is tied with the free end of reach 91*a* at 95.

Figure 5:
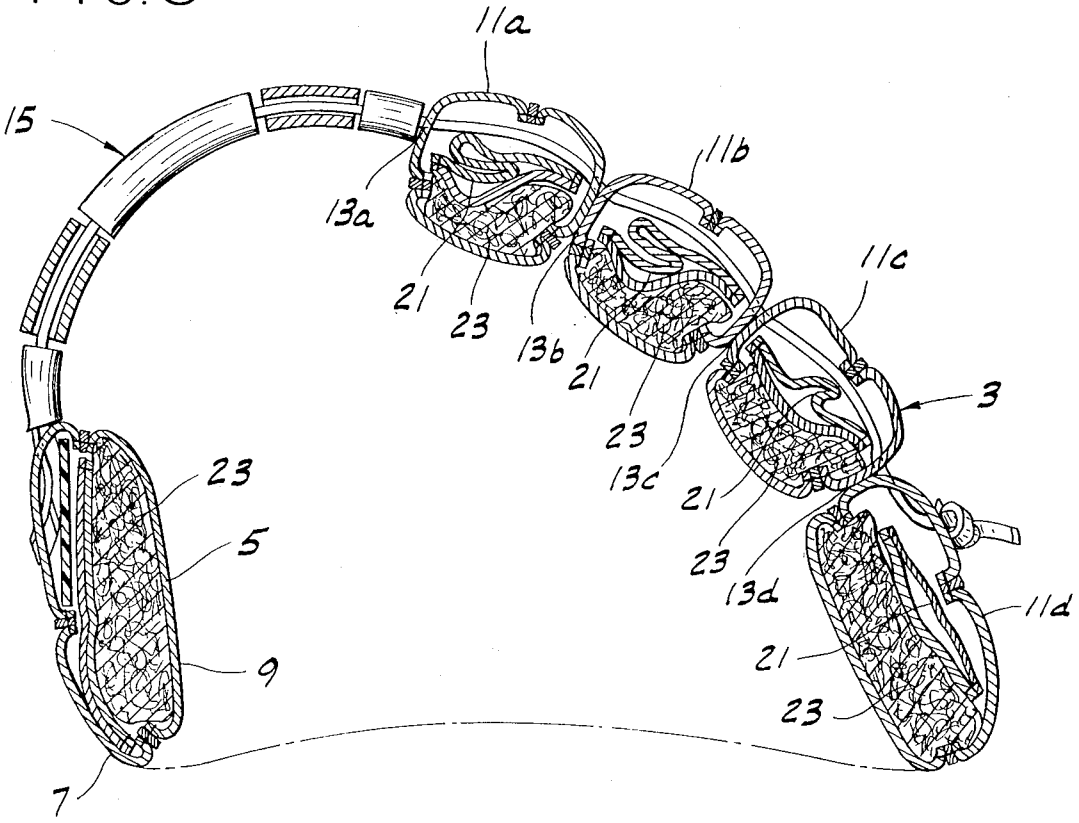
FIG. 5 is a horizontal section on line 5—5 of FIG. 2.

Lower lacing 83 comprises a pair of thongs or strips of lacing indicated at 101 and 103, each being of continuous, integral construction and having upper and lower reaches indicated at 101*a*, 101*b* and 103*a*, 103*b* lying in generally parallel planes extending generally at right angles to the finger stalls and spaced at intervals (vertical intervals as viewed in the drawings) along the finger stalls. Each of these reaches runs continuously along a curvilinear path, as viewed from above the glove (FIG. 5), through openings in the thumb stall, finger stalls and web.

More specifically, the upper reach 101*a* of thong 101 extends in one direction through openings in the finger stalls 11*a–*11*d* immediately rearward of the finger portions 23 of the padding, through tunnel 71*c* and thence through the back wall of the thumb stall before exiting the back wall of the glove at 107. The lower reach 101*b* of thong 101 doubles back and traverses the glove in the opposite direction, extending through the back wall of the thumb stall, through tunnel 71*d*, the finger stalls 11*a–*11*d* between the back wall of the glove and the finger portions 21 of the liner, and exiting the back wall of the little finger stall where it is tied with the free end of reach 101*a* at 109. The upper and lower reaches 103*a*, 103*b* of thong 103 traverse essentially the same path as thong 101 except at a location lower on the glove (with the upper reach 103*a* passing through tunnel 71*e* and the lower reach through 71*f*), the ends of the thong 103 being tied off at 111. Lacing 115 passes through tunnel 71*g* to secure the lower bridge member 41 to the glove.

It will be apparent from the foregoing construction that the depth of the web 15 and the spacings between the finger stalls 11*a–*11*d* are readily adjustable according to a player's preference merely by untying laces 91, 101 and 103, loosening or tightening the laces to adjust the depth of the web relative to the thumb stall 9 and the first finger stall 11*a* and the spacings between the individual finger stalls 11*a–*11*d* and then retying the laces to secure the glove in adjusted position. The fact that laces 91, 101 and 103 traverse the glove along curvilinear paths (as viewed from above the glove), rather than irregular (e.g., crisscross) paths, facilitates this adjustment and makes it quick and easy in comparison with gloves of conventional construction. The laces also stabilize the thumb stall, web and finger stalls so that the glove retains its shape over a longer period of time.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A baseball or softball glove comprising front and back walls joined together to form thumb and first-through-last finger stalls separated by intervening crothces, a web between the thumb and the first finger stall, upper lacing interconncting the thumb stall, web and finger stalls at their upper ends, and lower lacing interconnecting the thumb stall, web and finger stalls between their upper and lower ends, said lower lacing comprising a plurality of reaches of lacing lying in generally parallel planes extending generally at right angles to the finger stalls and spaced above the crotches at intervals along the finger stalls, each reach running continuously along a curvilinear path, as viewed from above the glove, through openings in the thumb stall, web and finger stalls, the depth of the web relative to the thumb stall and the first finger stall and the spacings between the individual finger stalls being readily adjustable by tightening or loosening said reaches of lower lacing.

2. A baseball or softball glove as set forth in claim 1 wherein said reaches of lower lacing have free ends adapted to be tied together for securing the thumb stall, web and finger stalls in adjusted position.

3. A baseball or softball glove as set forth in claim 2 wherein the free ends of the laces exit the back wall of the last finger stall.

4. A baseball or softball glove as set forth in claim 1 wherein said reaches of lacing pass through tunnels in the web extending generally transversely of the web.

5. A baseball or softball glove as set forth in claim 1 wherein said upper lacing comprises a plurality of reaches of lacing lying in generally parallel planes extending generally at right angles to the finger stalls and spaced at intervals along the finger stalls, each reach running continuously along a curvilinear path, as viewed from above the glove, through openings in the thumb stall, web and finger stalls.

6. A baseball or softball glove comprising front and back walls joined together to form thumb and first-through-last finger stalls, a web between the thumb and the first finger stall, upper lacing interconnecting the thumb stall, web and finger stalls at their upper ends, and lower lacing interconnecting the thumb stall, web and finger stalls between their upper and lower ends, said lower lacing comprising a plurality of reaches of lacing lying in generally parallel planes extending generally at right angles to the finger stalls and spaced at intervals along the finger stalls, each reach running continuously along a curvilinear path, as viewed from above the glove, through openings in the thumb stall, web and finger stalls, the depth of the web relative to the thumb stall and the first finger stall and the spacings between the individual finger stalls being readily adjustable by tightening or loosening said reaches of lower lacing, said reaches of lower lacing having free ends adapted to be tied together for securing the thumb stall, web and finger stalls in adjusted position, the free ends of the laces exiting the back wall of the last finger stall, said lower lacing comprising a plurality of separate strips, each strip being a continuous integral strip of lacing material having an upper reach traversing the glove in one direction, a lower reach doubling back and traversing the glove in the opposite direction, and free ends at one side of the glove adapted to be tied together to secure the thumb stall, web and finger stalls in adjusted position.

7. A baseball or softball glove as set forth in claim 6, wherein said upper and lower reaches of each strip pass through tunnels in the web extending generally transversely of the web.

8. A baseball or softball glove as set forth in claim 7 wherein said web comprises a plurality of generally parallel ross members extending the width of the web with their ends adjacent the thumb and first finger stalls, and a plurality of bridge members bridging the spaces between said cross members, said cross members and bridge members having interdigitated loop portions forming said tunnels.

9. A baseball or softball glove comprising front and back walls joined togehter to form thumb and first-through-last finger stalls, a web between the thumb and the first finger stall, upper lacing interconnecting the thumb stall, web and finger stalls at their upper ends, and lower lacing interconnecting the thumb stall, web and finger stalls between their upper and lower ends, said lower lacing comprising a plurality of reaches of lacing lying in generally parallel planes extending generally at right angles to the finger stalls and spaced at intervals along the finger stalls, each reach runnging continuously along a curvilinear path, as viewed from above the glove, through openings in the thumb stall, web and finger stalls, the depth of the web relative to the thumb stall and the first finger stall and the spacings between the individual finger stalls being readily adjustable by tightening or loosening said reaches of lower lacing, said reaches of lacing passing through tunnels in the web extending generally transversely of the web, said web comprising a plurality of generally parallel cross members extending the width of the web and connected at their ends to the thumb and first finger stalls, and a plurality of bridge members bridging the spaes between said cross members, said cross members and bridge members having interdigitated loop portions forming said tunnels for the lacing.

10. A baseball or softball glove as set forth in claim 9, wherien said lower lacing comprises a plurality of separate strips, each strip being a continuous integral strip of lacing material having an upper reach traversing the glove in one direction, a lower reach doubling back and traversing the glove in the opposite direction, and free ends at one side of the glove adapted to be tied together to secure the thumb stall, web and finger stalls in adjusted position.

11. A baseball or softball glove comprising front and back walls joined together to form thumb and first-through-last finger stalls, a web between the thumb and the first finger stall, upper lacing interconnecting the thumb stall, web and finger stalls at their upper ends, and lower lacing interconnecting the thumb stall, web and finger stalls between their upper and lower ends, said lower lacing comprising a plurality of reaches of lacing lying in generally parallel planes extending generally at right angles to the finger stalls and spaced at intervals along the finger stalls, each reach running continuously along a curvilinear path, as viewed from above the glove, through openings in the thumb stall, web and finger stalls, the depth of the web relative to the thumb stall and the first finger stall and the spacings between the individual finger stalls being readily adjustable by tightening or loosening said reaches of lower lacing, said upper lacing comprising a plurality of reaches of lacing lying in generally parallel planes extending generally at right angles to the finger stalls and spaced at intervals along the finger stalls, each reach running continuously along a curvilinear path, as viewed from above the glove, through openings in the thumb stall, web and finger stalls, said upper lacing comprising a continuous integral strip of lacing material having an upper reach traversing the glove in one direction and a lower reach doubling back and traversing the glove in the opposite direction, and free ends at one side of the glove adapted to be tied together.

* * * * *

UNITED STATES PATENT AND TRADEMARK OFFICE

CERTIFICATE OF CORRECTION

PATENT NO. : 4,720,875

DATED : January 26, 1988

INVENTOR(S) : Roland N. Latina; Robert L. Clevenhagen

It is certified that error appears in the above—identified patent and that said Letters Patent is hereby corrected as shown below:

Column 4, line 27, "crothces, a web" should read --crotches, a web--. Column 5, line 28, "parallel ross members" should read --parallel cross members--.

Signed and Sealed this

Twenty-ninth Day of November, 1988

*Attest:*

DONALD J. QUIGG

*Attesting Officer*

*Commissioner of Patents and Trademarks*